US005437088A

United States Patent [19]

Igarashi

[11] Patent Number: 5,437,088

[45] Date of Patent: Aug. 1, 1995

[54] METHOD OF MAKING A GOLF CLUB THAT PROVIDES ENHANCED BACKSPIN AND REDUCED SIDESPIN

[76] Inventor: Lawrence Y. Igarashi, 30231 Tomas Rd., Rancho Santa Margarita, Calif. 92688

[21] Appl. No.: 315,185

[22] Filed: Sep. 29, 1994

Related U.S. Application Data

[63] Continuation of Ser. No. 185,324, Jan. 21, 1994, abandoned, which is a continuation of Ser. No. 5,636, Jan. 19, 1993, abandoned.

[51] Int. Cl.[6] ..... B23P 17/00

[52] U.S. Cl. ..... 29/527.6; 29/527.5

[58] Field of Search ..... 29/527.6, 527.5

[56] References Cited

U.S. PATENT DOCUMENTS

| | | | |
|---|---|---|---|
| 3,869,126 | 3/1975 | Thompson | 273/175 |
| 4,753,440 | 6/1988 | Chorne | 273/175 X |
| 4,964,641 | 10/1990 | Miesch et al. | 273/175 |
| 5,029,864 | 7/1991 | Keener | 273/175 |
| 5,090,702 | 2/1992 | Viste | 273/167 H |
| 5,121,519 | 6/1992 | Haugom | 15/105 |
| 5,232,224 | 8/1993 | Zeider | 273/167 H |

FOREIGN PATENT DOCUMENTS

| | | | |
|---|---|---|---|
| 0023877 | 1/1991 | Japan | 273/175 |

OTHER PUBLICATIONS

"MacGregor", *Golf Digest*, Feb. 1988, p. 51.

*Primary Examiner*—Irene Cuda

*Assistant Examiner*—Marc W. Butler

*Attorney, Agent, or Firm*—Roberts and Quiogue

[57] ABSTRACT

An improved golf club wherein the surface of the face of the club is substantially flat, which is achieved by surfacing (milling) the club face, and wherein the edges of scoring lines (grooves) are made relatively sharp as a result of the surfacing operation. The sharp groove edges (and milling lines) of the present invention produce enhanced backspin and reduced sidespin when a golf ball is struck, which results in a relatively straight golf ball flight path, notwithstanding a glancing club impact angle. In addition, milling lines that may be formed on the club face are generally parallel to the scoring lines and hence enhance the club characteristics. The present invention also provides for methods of making a golf club that has the above features, including forging and casting methods. In either method, a club is processed to produce generally smooth and finished features with scoring lines formed in the face of the club. After the scoring lines are formed, the club face is surfaced (milled) to produce a flat club face and relatively sharp groove edges at the surface of the club face. The surface of the club face may be milled such that the milling texture or milling marks are generally aligned with the scoring lines. This improves the ball spinning capability of the present club. The shape of the scoring lines is not critical to the performance of the club. Any cross sectional shape may be used, including square, V- or triangular-shaped, or curved shapes. The critical point is that the edges of the grooves adjacent the flat club face are sharp, and a right angle edge is optimum.

19 Claims, 4 Drawing Sheets

METHOD OF MAKING A GOLF CLUB THAT PROVIDES ENHANCED BACKSPIN AND REDUCED SIDESPIN

This is a continuation of application Ser. No. 08/185,324 filed on Jan. 21, 1994, abandoned, which is a continuation of Ser. No. 08/005,636 filed Jan. 19, 1993, now abandoned.

BACKGROUND

The present invention relates generally to golf clubs and manufacturing methods therefor, and more particularly, to a golf club that produces a relatively straight golf ball flight path notwithstanding a glancing impact angle, and hence produces enhanced backspin and reduced sidespin, and methods of making such a golf club.

There has been a great deal of controversy and numerous articles have been written regarding golf clubs having "square grooves". Much of the controversy deals with the amount of backspin that the club imparts to the golf ball when struck. An accomplished player has the ability to produce a great deal of backspin on the golf ball, which is readily apparent when watching a professional tournament. However, the U.S. Golf Association (USGA) has guidelines and specifications that control the depth and spacing of grooves in golf clubs that are used by players in its tournaments. Consequently, although golf club manufacturers produce clubs that have relatively square grooves, they must be manufactured to be within the USGA specifications.

Conventional clubs also cause sidespin when they strike a golf ball. When a club strikes a golf ball at a glancing angle relative to the swing path, a clockwise or counterclockwise sidespin is imparted to the ball which causes the golf ball to fade, slice, draw, or hook, depending upon the impact angle. Club manufacturers attempt to design their clubs to minimize this effect, and hence to produces a more accurate ball striking club.

Golf clubs are typically made by forging or investment casting processes. In a conventional forging process, a female mold is made having the general shape of a desired club. The female mold is placed in a mold base of a forging press. A piece of hot metal is placed in the mold, and the hot metal is pounded into a desired club shape using the press. This produces a club having rough features. Then, a grinding operation is performed on the club which produces generally smooth and finished features. Scoring lines (grooves) are then cut into the face of the club, typically by means of a set of rolling blades. After the scoring lines are formed, a second grinding operation is performed to finish forming the club. The club is then vibrated to remove residue produced by the scoring and grinding operations. The scoring lines are also sandblasted. Finally, the club is plated to produce a finished product.

In a conventional investment casting process, a master male mold is made having a desired club shape. Then a female mold is made using the master male mold. A wax member is then molded having the desired club shape using the female mold. A tree is made using a plurality of wax members, and the tree is dipped into a number of vats of ceramic "batter" having different size ceramic particles on top which successively coats the wax members with layers of ceramic. This results in a tree comprising a plurality of wax members captivated by a ceramic shell. The ceramic shell containing the plurality of wax members are then steam heated to melt the wax, thus leaving a ceramic shell having cavities therein that conform to the desired shape of the club. The shell is then heated to substantially the same temperature as molten metal that is to be poured into it. After heating the shell, molten metal is poured into the shell, and the shell is allowed to cool, leaving formed metal clubs in the cavities. The scoring lines are formed as part of the molding process. The cast clubs are then removed from the shell and each is subjected to a grinding operation to produce a desired club shape. The clubs are then vibrated to remove the residue from the grinding operation. The clubs are then polished and sandblasted to produce the finished product.

In either of these manufacturing processes, the face of the club that is produced is not flat, and in particular, the face has an uneven, wavy, cavity filled surface, due to shrinkage of the wax and metal, grinding and sandblasting. Also, the grooves (scoring lines) do not have sharp edges, in that they are generally rounded at the edges of the surface of the club face.

Accordingly, it is an objective of the present invention to provide a golf club that has a club face and groove structure that produces enhanced backspin and reduced sidespin when it strikes a golf ball, and hence produces a flight path that is relatively straight relative to the impact angle of the club on the ball. It is also an objective of the present invention to provide methods of making a golf club that produces enhanced backspin and reduced sidespin and gear effect when it strikes a golf ball.

SUMMARY OF THE INVENTION

The assignee of the present invention has performed considerable research into groove shapes and club face design. It has been determined that the edge of the grooves (and not the specific groove shape) along with the surface flatness of the face of the club, may be designed so as to enhance backspin and reduce the sidespin caused by the club when it strikes a golf ball. This produces a golf club that has improved performance and more accuracy. These two factors may be controlled to produce a golf club that causes a golf ball to have a relatively straight flight path after being struck by the club.

The present invention is an improved golf club that has several distinct features. First, the surface of the face of the club is made substantially flat, which is achieved by precision milling the club face, or by surfacing it using other available means. This removes any waviness in the surface of the club face that is typically found in conventional clubs. Second, the edges of the scoring lines (grooves) are made relatively sharp as a result of the surfacing (milling) operation, and they are very sharp when compared to grooves of conventional clubs. The sharp groove edges cause a struck golf ball to have backspin. Consequently, the struck golf ball will have a relatively straight flight path, or trajectory, due to the backspin imparted to the golf ball. Thus the slice and hook flight paths produced by conventional clubs are substantially reduced. Furthermore, the surface of the club is milled such that the milling texture or milling marks are generally aligned with the scoring lines. This improves the ball spinning capability of the present club.

The present invention also provides for methods of making a golf club that has the above features. One forging process is as follows for a single club, although multiple clubs may also be made at the same time using the present invention. A female mold is made having the general shape of a desired club. The female mold is placed in a mold base of a forging press. Hot metal is placed in the mold, and it is pounded into a desired club shape using the press. This produces a club having rough club features. Then, a grinding operation is performed on the club to produce generally smooth and finished features. Scoring lines (grooves) are then cut into the face of the club. After the scoring lines are formed, the club face is surfaced (milled) to produce a flat club face and sharp groove edges adjacent the club face. The surfacing operation may be performed using computerized numerical controlled (CNC) milling machines, for example.

One casting process is as follows that illustrates a process for casting several clubs at one time, although a single club may also be made using the present invention. A master male mold is made having a desired club shape. Then a female mold is made using the master male mold. A wax member is then molded having the desired club shape using the female mold. A tree is formed using a plurality of wax members, and a ceramic shell is formed around the tree. The ceramic shell containing the plurality of wax members are then heated to melt the wax, leaving a ceramic shell having cavities therein that conform to the desired shape of the club. The shell is then heated to substantially the same temperature as molten metal that is to be poured into it. After heating the shell, molten metal is poured into the shell, and the shell is allowed to cool, leaving formed metal clubs in the cavities. Scoring lines are typically formed as part of the molding process. The cast clubs are then removed from the shell and each is subjected to a grinding operation to produce a desired club shape. Each cast club is then surfaced (milled) to produce a flat club face and sharp groove edges adjacent the club face. The surfacing operation may be performed using CNC milling machines, for example.

The shape of the grooves (scoring lines) of the golf club of the present invention is not critical to the performance of the club. Any groove cross sectional shape may be used, including square, V- or triangular-shaped, or curved shapes. The critical point is that the edges of the grooves at the surface of the club face are sharp, and a right angle edge is optimum. The shape of the bottom of the groove is not very relevant to the performance of the present golf club. Consequently, any manufacturing process that produces such a club face and groove arrangement is satisfactory.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 1*a* illustrates a perspective view of a golf club made in accordance with the principles of the present invention, while

DETAILED DESCRIPTION

Figure 1A:
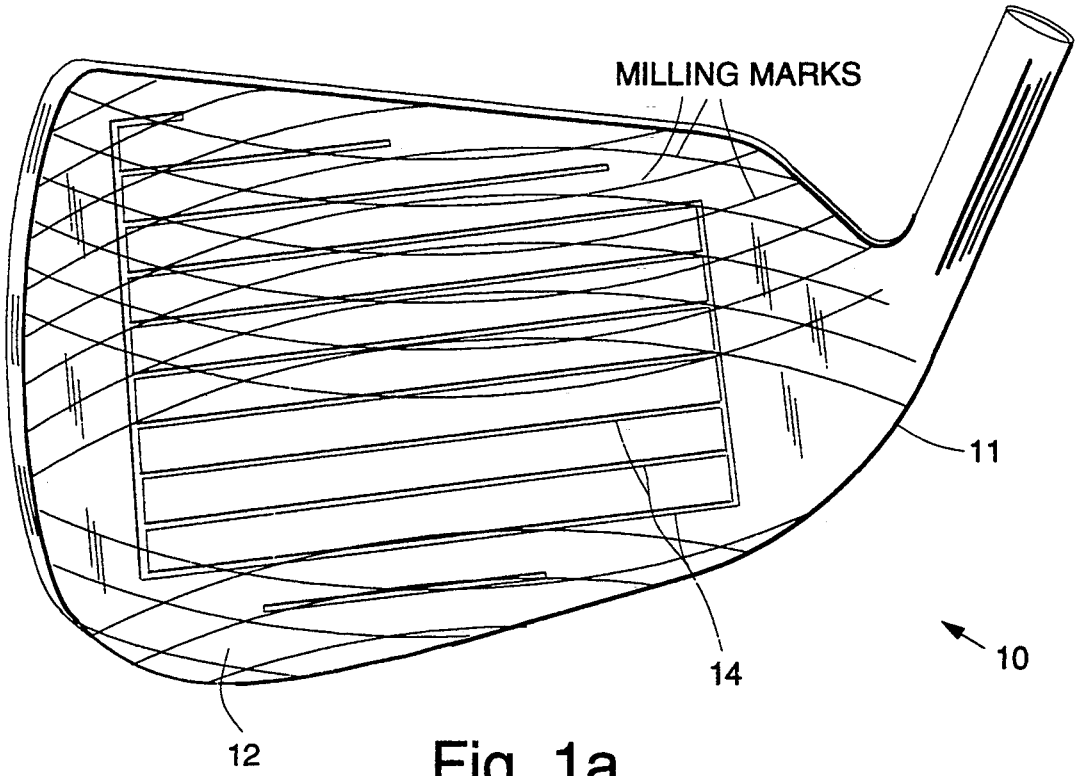
Figure 1B:
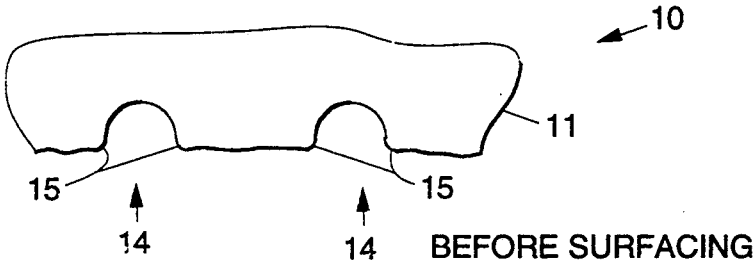
FIGS. 1*b* and 1*c* are enlarged partial cross sections of the golf club at two stages of manufacture and illustrate the improvements provided by the present invention.
Figure 1C:
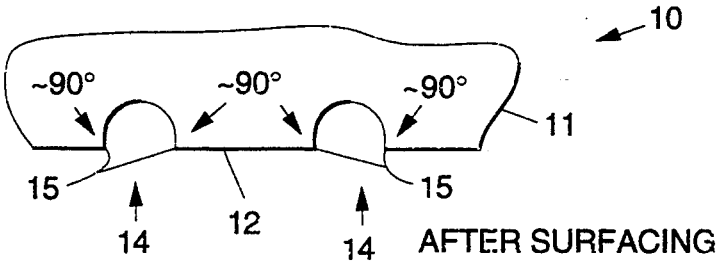

Referring to the drawing figures, FIG. 1 a illustrates a perspective view of a golf club 10 (or golf club head 10) made in accordance with the principles of the present invention, while FIGS. 1*b* and 1*c* are two enlarged partial cross sections of the golf club 10 at two stages of manufacture. These two cross sectional views represent two points during the manufacture of the club 10 and illustrate the improvements provided by the present invention. The golf club 10 is comprised of a club body 11 that has a front face 12 or front surface 12 that is adapted to strike a golf ball when the finished golf club 10 is swung by a golfer. A plurality of scoring lines 14 (grooves 14) are formed in the front face 12. A shaft and grip (not shown) are connected to the club body 11 in a conventional manner to complete the finished product. The improvements of the present invention deal with the golf club body 11, front face 12, and the scoring lines 14.

Figure 3A:
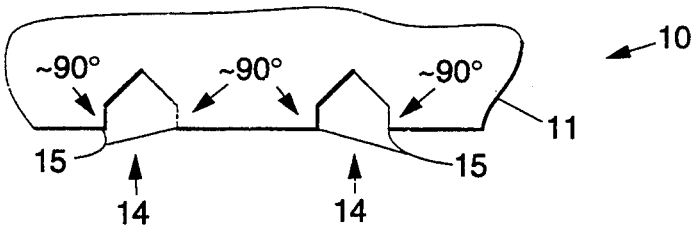
FIGS. 3*a*–3*c* show cross sections of the present golf club illustrating different groove shapes.
Figure 3B:
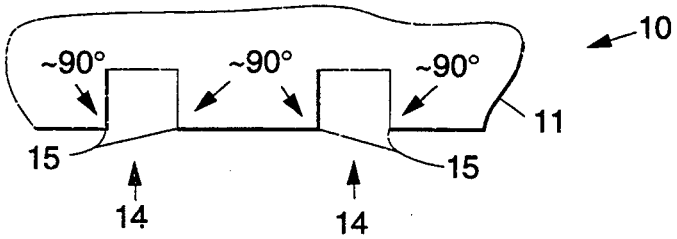
Figure 3C:
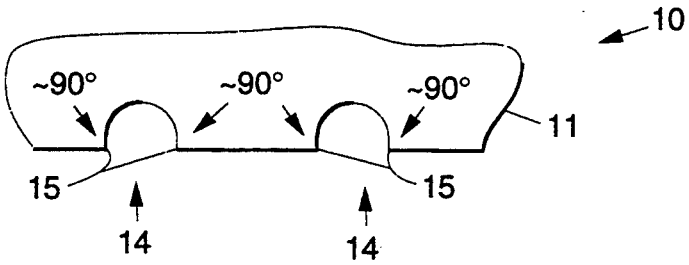

Referring to FIG. 1*b*, which shows the club 10 after it has been molded or cast into shape and has scoring lines 14 (grooves 14) formed the front face 12 thereof. As can be seen in FIG. 1*a*, the surface of the front face 12 is not flat, and in fact the front face 12 is generally wavy. This surface finish is typically produces by all conventional manufacturing processes. The scoring lines 14 have rounded edges 15 adjacent the front face 12. This is generally true irrespective of the shape of the scoring lines 14. The scoring lines 14 may be any desired shape, including square, V- or triangular-shaped, or curved shapes, for example, and which is are shown in FIGS. 3*a*–3*c* and described below.

Referring now to FIG. 1*c*, the front face 12 of the club 10 has been surfaced in accordance with the principles of the present invention, typically with a computerized numerical controlled (CNC) precision milling machine. The milling, or comparable surfacing operation, produces a substantially flat front face 12 of the club 10. This in turn produces scoring lines 14 having relatively sharp edges 15 at the front face 12. This is clearly shown in FIG. 1*b*, and is the essence of the present invention.

Figure 2:
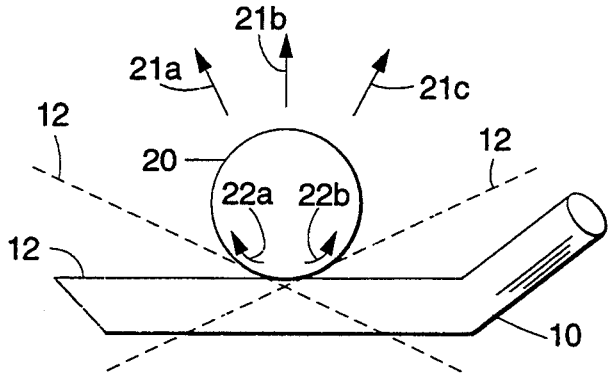
FIG. 2 illustrates the advantages produced by the golf club of the present invention.

Referring to FIG. 2, it illustrates the advantages produced by the golf club 10 of the present invention. FIG. 2 shows the golf club 10 impacting a golf ball 20, and shows several possible orientations and directions of travel of the club 10 at the instant of impact, shown by dashed lines and directional arrows 21*a*–21*c*. Normally, a glancing blow of the club 10 on the ball 20 in any direction other than straight causes the ball 20 to rotate counter to the direction of impact of the club 10. This is indicated by the rotational arrows 22*a*, 22*b*. This results in undesired rotation of the ball 20 and causes a draw (hook) or a fade (slice) depending upon the angle of impact. It has been found that a club 10 made in accordance with the principles of the present invention, namely that has a flat front face 12 and sharp groove edges 15, does not impart much sidespin to the ball 20. The edge of the grooves (and not the specific groove shape) along with the surface flatness of the face 12 of the club, cause enhanced backspin and reduced sidespin to be imparted by the club 10 when it strikes the golf ball 20. Consequently, when the golf ball 20 struck with the present golf club 10 it will have a flight path which is generally perpendicular to the club face 12 (shown by arrows 21*a*–21*c*), and which will not slice or hook relative to this flight path after it leaves the club face 12.

The following is presented to provide a better understanding of the physics relating to the improvements provided by the present invention. The flight of the golf ball 20 is determined by the interactions of the ball 20 with the club face 12 diring impact and by the interaction of the ball 20 with the air during flight. Many of the aerodynamic effects on the golf ball 20 are determined by the spin induced on the ball 20 during impact with the club face 12. It is well known that the golf ball 20 is slowed down in the air by drag. What is less widely known, but which is no less important, relates to the aerodynamic force perpendicular to the ball's flight path caused by the spin of the ball 20. This perpendicular force is called the Magnus force. The Magnus force can lead to additional lift forces away from the ground as well as producing golf ball trajectories that curve to the left or right (draw or fade). Hence, the ball spin produced at impact with the club face 12 causes the ball trajectory to deviate substantially from a simple parabolic path of normal simple projectile motion.

It is the express purpose of the present invention to provide a golf club 10 that reduces the lateral Magnus force experienced by the golf ball 20 during its flight. This is a result of the surfaced club face 12 and sharp groove edges 15. The present golf club 10 imparts a higher ratio of backspin to sidespin to the golf ball 20, thereby reducing the relative and absolute magnitude of the fade or draw effect.

The grooves and surface finish present in the golf club 10 of the present invention reduce golf ball sidespin by changing the fundamental frictional interaction of the ball 20 with the club face 12 during impact. The coefficient of friction (m) may be increased and given a directional characteristic using the golf club 10 of the present invention. That is to say, the present golf club 10 enhances the frictional coefficient of the ball-club interaction in a way that reduces the ball sidespin, thereby reducing the drawing or fading of the ball 20 in flight due to lateral Magnus forces, while at the same time causing no adverse effects on the desirable backspin imparted to the ball 20.

For the purposes of completeness, FIGS. 3*a*–3*c* show cross sections of different groove shapes that may be employed with the golf club 10. The shape of the grooves 14 (scoring lines) is not critical to the performance of the club 10. Any cross sectional shape may be used, including V- or triangular-shaped, square, or curved shapes, as are shown in FIGS. 3*a*–3*c*, respectively. The critical point is that the edges 15 of the grooves 14 at the club face 12 are sharp, and a right angle edge is optimum. However, an angle that is not exactly 90 degrees is not absolutely required, in that it is the sharp edge and fiat club face 12 that is important. The performance of the club 10 would be less than optimum for grooves that are not sharp, however. Furthermore, the shape of the bottom of the groove 14 is not very relevant to the performance of the present golf club 10.

Figure 4:
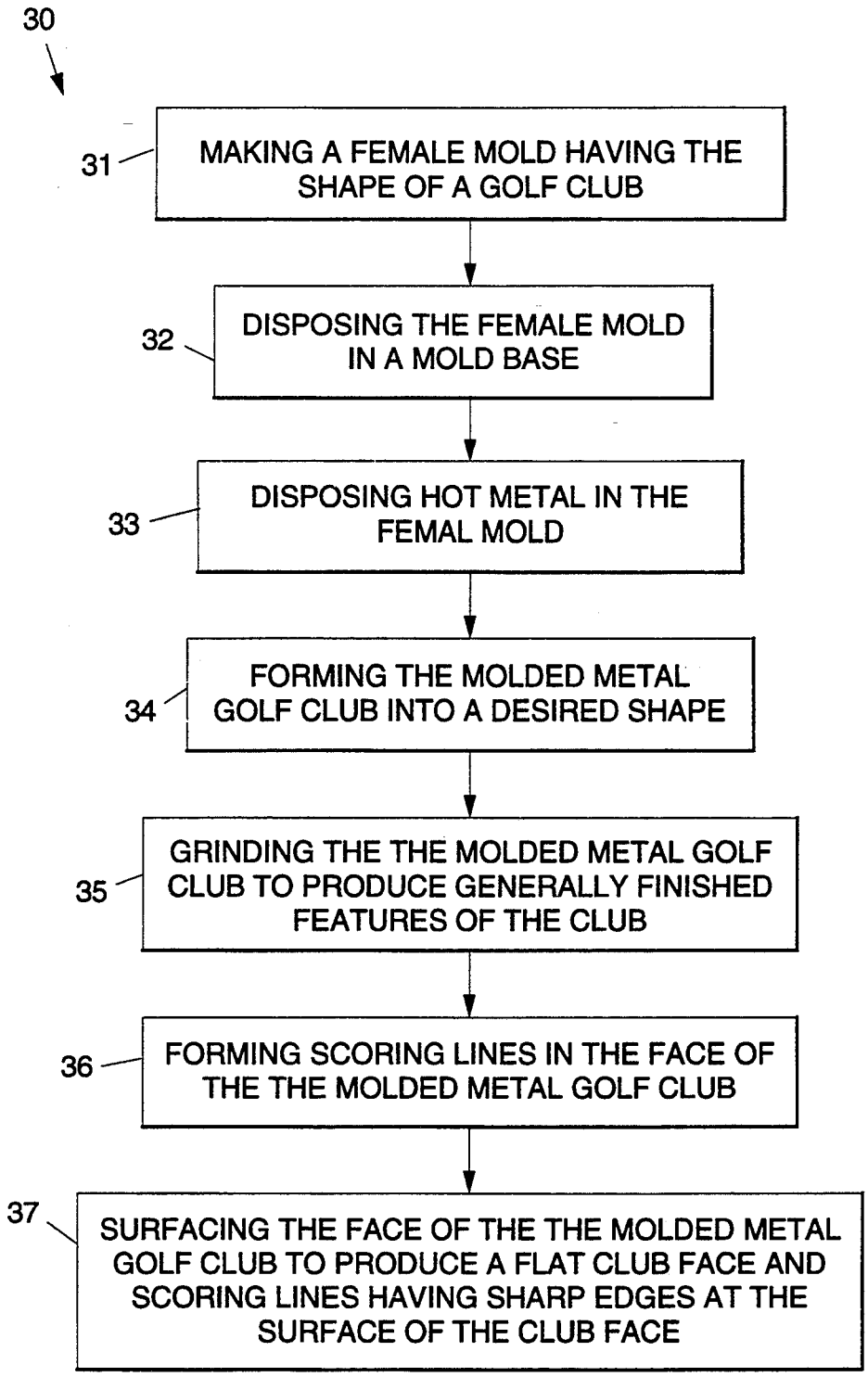
FIG. 4 shows a flow diagram of a first method of making a golf club in accordance with the principles of the present invention.

The golf club 10 may be manufactured using a variety of manufacturing processes, including forging and investment casting processes, for example. FIG. 4 shows a flow diagram of a first method of making a golf club in accordance with the principles of the present invention. The first method is a forging method 30 that illustrates forging of a single club 10. However, it is to be understood that multiple clubs may be forged at the same time with the appropriate equipment. A female mold is made having the general shape of a desired club (step 31). The female mold is placed in a mold base of a forging press (step 32). Hot metal is poured into the mold (step 33), and it is pounded into a desired club shape using the press (step 34). This produces a club having rough club features. Then, a grinding operation is performed on the club 10 which produces generally finished features (step 35). Scoring lines 14 (grooves) are then formed in the face 12 of the club 10 (step 36). After the scoring lines 14 are formed, the club face 12 is surfaced to produce a flat club face and sharp groove edges 15 at the surface of the club face 12 (step 37). The surfacing operation may be performed using a computerized numerical controlled (CNC) milling machine, for example.

Figure 5:
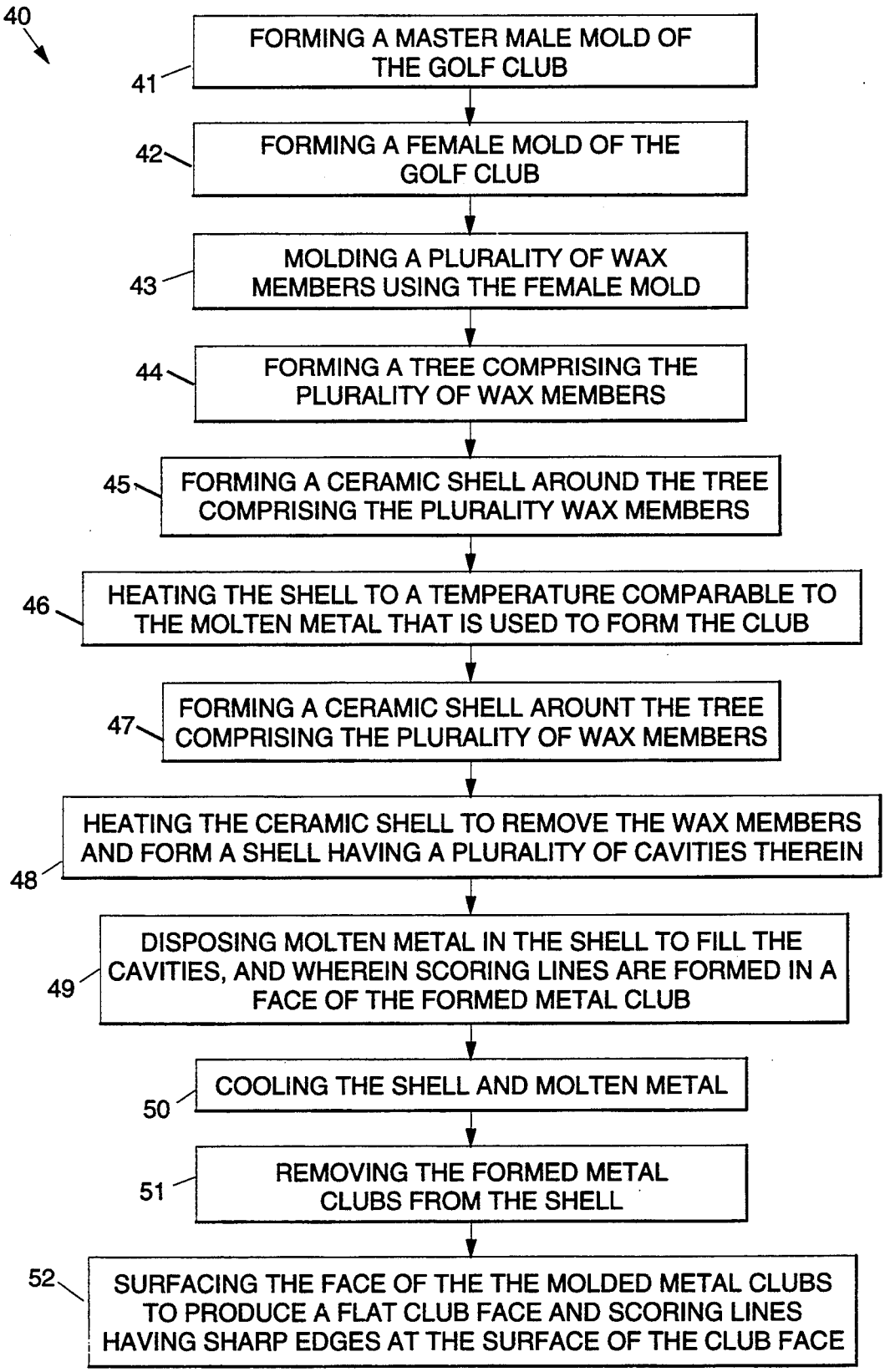
FIG. 5 shows a flow diagram of a second method of making a golf club in accordance with the principles of the present invention.

FIG. 5 shows a flow diagram of a second method of making a golf club 10 in accordance with the principles of the present invention. The second method is an investment casting method 40. The casting method 40 illustrates a process for casting several clubs 10 at tone time, although a single club 10 may also be made using the present invention. A master male mold is made having a desired club shape (step 41). Then a female mold is made using the master male mold (step 42). A plurality of wax members are then molded having the desired club shape using the female mold (step 43). A tree is formed using a plurality of wax members (step 44), and a ceramic shell is formed around the tree (step 45). The ceramic shell containing the plurality of wax members are then heated to melt the wax (step 46), leaving a ceramic shell having cavities therein that conform to the desired shape of the club 10. The shell is then heated to substantially the same temperature as molten metal that is to be poured into it (step 477). After heating the shell, molten metal is poured into the heated shell (step 48), and the shell is allowed to cool (step 49), leaving formed metal clubs in the cavities. Scoring lines 14 are formed as part of the molding process. The cast clubs 10 with the scoring lines therein are then removed from the shell (step 50) and each is subjected to a grinding operation to produce a desired club shape (step 51). Each cast club 10 is then surfaced (milled) to produce a flat club face and sharp groove edges 15 at the surface of the club face 12 (step 52). The surfacing operation may be performed using a CNC milling machine, for example. It is to be understood that the grooves 14 may be formed subsequent to casting, in a manner similar to that described with reference to the forging method 30, and prior to the surfacing step (step 52).

Thus there has been described a new and improved golf club that produces a relatively straight golf ball flight path notwithstanding a glancing impact angle, and hence produces enhanced backspin and reduced sidespin, and methods of making such a golf club. It is to be understood that the above-described embodiments are merely illustrative of some of the many specific embodiments which represent applications of the principles of the present invention. Clearly, numerous and other arrangements can be readily devised by those skilled in the art without departing from the scope of the invention.

What is claimed is:

1. A method of making a golf club comprising the steps of:

disposing hot metal into a mold having the shape of a golf club;

forging the hot metal to form a forged golf club having a desired shape;

removing the forged metal golf club from the mold;

grinding the forged metal golf club to produce generally finished features of the club;

forming scoring lines in the ball striking face of the forged metal golf club, wherein edges are defined at each side of each line at said surface; and surfacing the ball striking face of the forged metal golf club to produce a flat ball striking face, each of said edges of said scoring lines being made sharp at the surface of the flat club face by said surfacing.

2. The method of claim 1 wherein the step of forming scoring lines comprises the step of milling grooves in said ball striking face, said grooves having a U-shaped cross section.

3. The method of claim 1 wherein the step of forming scoring lines comprises the step of milling grooves having a triangular-shaped cross section.

4. The method of claim 1 wherein the step of forming scoring lines comprises the step of milling grooves having a square-shaped cross section.

5. The method of claim 1 wherein the step of forming scoring lines comprises the step of milling grooves having a curved cross section.

6. The method of claim 1 wherein the step of surfacing the ball striking face comprises the step of milling said face with a milling tool to produce said flat surface.

7. The method of claim 6 wherein said step of milling said face comprising using a numerically controlled milling machine to mill said surface to produce said flat surface.

8. A method of making a cast golf club comprising the steps of:

forming a wax mold of a golf club having scoring lines disposed in a front face thereof;

encapsulating the wax mold in a ceramic shell;

heating the ceramic shell and wax mold to melt the wax mold and form a shell with a cavity disposed therein;

heating the shell to a temperature substantially the same as molten metal that is to form the golf club;

pouring the molten metal into the shell;

cooling the shell and molten metal;

removing the cast golf club from the shell; and surfacing the face of the cast golf club to produce a substantially flat ball striking face surface, said surfacing further producing sharp edges of said scoring lines at said ball striking surface.

9. The method of claim 8 wherein said scoring lines comprise grooves formed in said face surface, said grooves having a U-shaped cross section.

10. The method of claim 8 wherein scoring lines comprise grooves formed in said face surface, said grooves having a triangular-shaped cross section.

11. The method of claim 8 wherein said scoring lines comprise grooves formed in said face surface, said grooves having a square-shaped cross section.

12. The method of claim 8 wherein said scoring lines comprise grooves formed in said face surface, said grooves having a curved cross section.

13. The method of claim 8 wherein the step of surfacing the face comprises the step of milling said face with a milling tool to produce said flat surface.

14. A method of making a golf club, comprising a sequence of the following steps:

providing a golf club head body including a ball striking face surface;

forming a plurality of grooves in said face surface and which penetrate below said face surface, said forming of said grooves defining a pair of edges of each said groove at said face surface; and milling said face surface by use of a milling tool to produce a flat face surface which is made flat as a result of said milling, and wherein each of said edges of each said groove are sharply defined as a further result of said milling.

15. The method of claim 14 wherein said step of milling said face surface comprising using a numerically controlled milling machine to mill said surface to produce said flat surface.

16. The method of claim 14 wherein the step of forming said grooves comprises the step of milling grooves in said ball striking face, said grooves having a U-shaped cross section.

17. The method of claim 14 wherein the step of forming said grooves comprises the step of milling grooves having a triangular-shaped cross section.

18. The method of claim 14 wherein the step of forming said grooves comprises the step of milling grooves having a square-shaped cross section.

19. The method of claim 14 wherein the step of forming said grooves comprises the step of milling grooves having a curved cross section.

* * * * *